US008222771B2

(12) United States Patent
Coley et al.

(10) Patent No.: US 8,222,771 B2
(45) Date of Patent: Jul. 17, 2012

(54) ILLUMINATED PUSHBUTTON SWITCH WITH ELECTRONIC LATCHING AND BLINKING FEATURE

(75) Inventors: Craig Jay Coley, Burleson, TX (US); Steven A. Edwards, North Richland Hills, TX (US)

(73) Assignee: Aerospace Optics, Inc., Fort Worth, TX (US)

( * ) Notice: Subject to any disclaimer, the term of this patent is extended or adjusted under 35 U.S.C. 154(b) by 253 days.

(21) Appl. No.: 12/701,543

(22) Filed: Feb. 6, 2010

(65) Prior Publication Data

US 2010/0327943 A1 Dec. 30, 2010

Related U.S. Application Data

(60) Provisional application No. 61/207,016, filed on Feb. 6, 2009.

(51) Int. Cl.
*H01H 3/00* (2006.01)

(52) U.S. Cl. ..... 307/139

(58) Field of Classification Search ..... 307/139
See application file for complete search history.

(56) References Cited

U.S. PATENT DOCUMENTS

| | | | |
|---|---|---|---|
| 3,683,350 | A | 8/1972 | Shedenheim |
| 4,535,396 | A | 8/1985 | Guthrie |
| 4,592,003 | A | 5/1986 | Kobayashi et al. |
| 2005/0231946 | A1 | 10/2005 | Guthrie |

OTHER PUBLICATIONS

International Search Report issued on May 12, 2010 in connection with International Patent Application No. PCT/US2010/023423.
Written Opinion issued on May 12, 2010 in connection with International Patent Application No. PCT/US2010/023423.

*Primary Examiner* — Robert L. Deberadinis

(57) ABSTRACT

Within an illuminating pushbutton switch, an electronic circuit replaces an electromagnetic holding coil for latching or releasing a state of the illuminated pushbutton switch, and further provides blinking functionality. The electronic circuit includes inputs receiving set, reset and toggle control signals, outputs delivering open, closed and blink control signals, latch logic controlled by the set and reset control signals and delivering signals maintaining the illuminated pushbutton switch in either an open or closed state, and a frequency divider and oscillator coupled together to deliver a blink control signal. The electronic circuit fits within the illuminated pushbutton switch housing in space sized to hold two snap action switching devices without increase in the length, weight or mounting depth of the illuminated pushbutton switch. The inputs and outputs are coupled to external pins from the illuminated pushbutton switch and may be remotely controlled.

14 Claims, 3 Drawing Sheets

ILLUMINATED PUSHBUTTON SWITCH WITH ELECTRONIC LATCHING AND BLINKING FEATURE

CROSS-REFERENCE TO RELATED APPLICATION(S) AND CLAIM OF PRIORITY

This application claims priority to commonly assigned U.S. Provisional Patent Application No. 61/207,016, filed Feb. 6, 2009, which is hereby incorporated by reference.

TECHNICAL FIELD

The present disclosure is directed, in general, to illuminated pushbuttons switches, and more specifically to implementing electronic latching and blinking features for illuminated pushbutton switches.

BACKGROUND

Within the realm of illuminated pushbutton switch usage, specialized applications are emerging requiring inclusion of latching, blinking or remote control functions to be included within the illuminated pushbutton switch housing. Such applications may require depressing the pushbutton switch to initiate a remote action request, activating switch functions from a remote location, energizing or blinking a local or remote display, and resetting the switch state automatically upon remote acknowledgement. Other applications may involve a plurality of illuminated pushbutton switches in differing locations, all controlling the same functions, wherein a switch depressed at one location must change the state of a switch or display at another location. Nearly all applications require the added safety feature of an automatic reset to a default state after loss of power.

Proposed designs may incorporate local latching and remote release functions through the use of internal electromagnetic holding coils, in some cases together with various electronic or electromechanical means to interrupt the holding coil current locally without remote intervention. Many of the proposed designs that rely upon an internal electromagnetic holding coil suffer from excessive power consumption, excessive heat, sensitivity to shock and physical jarring, electrical spikes, holding coil drop-out on low voltage, and low reliability. The internal holding coil also makes the resulting illuminated pushbutton switch substantially longer and heavier than standard models that do not incorporate a holding coil.

There is, therefore, a need in the art for improved latching and release in pushbutton switches, together with other features.

SUMMARY

Within an illuminating pushbutton switch, an electronic circuit replaces an electromagnetic holding coil for latching or releasing a state of the illuminated pushbutton switch, and further provides blinking functionality. The electronic circuit includes inputs receiving set, reset and toggle control signals, outputs delivering open, closed and blink control signals, latch logic controlled by the set and reset control signals and delivering signals maintaining the illuminated pushbutton switch in either an open or closed state, and a frequency divider and oscillator coupled together to deliver a blink control signal. The electronic circuit fits within the illuminated pushbutton switch housing in space sized to hold two snap action switching devices without increase in the length, weight or mounting depth of the illuminated pushbutton switch. The inputs and outputs are coupled to external pins from the illuminated pushbutton switch and may be remotely controlled.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1A:
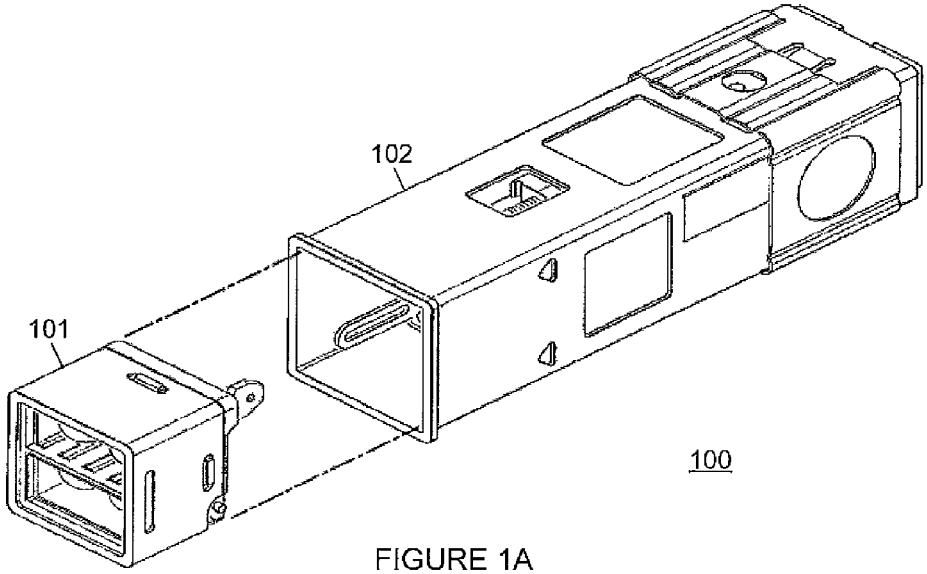
FIGS. 1A, 1B and 1C are exploded perspective views of a pushbutton illuminated switch (or components thereof) with electronic latching and/or blinking according to one embodiment of the present disclosure.
Figure 1B:
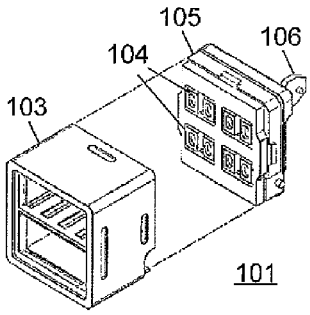
Figure 1C:
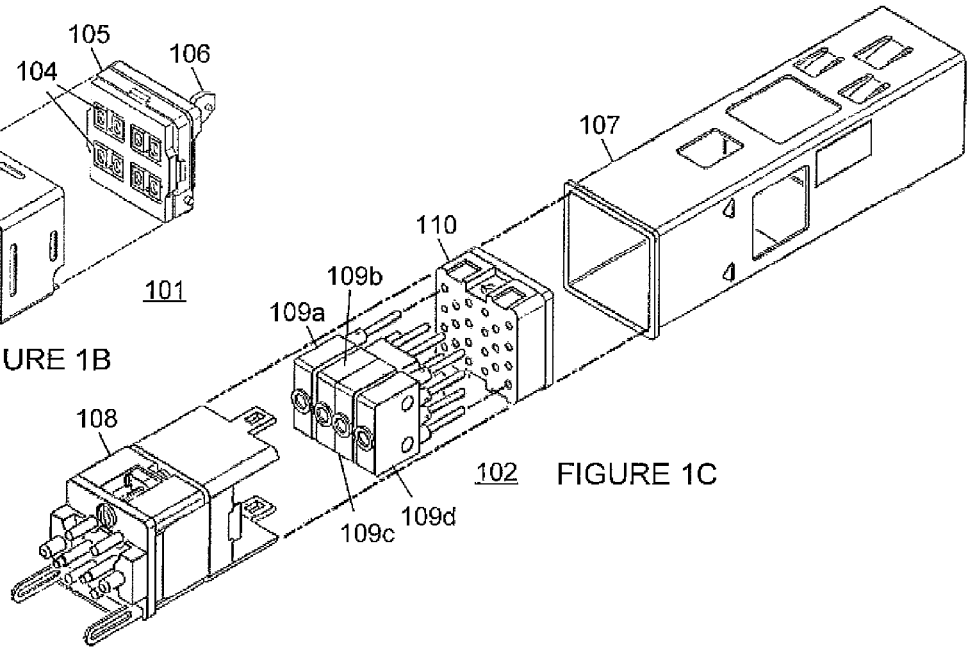
Figure 1D:
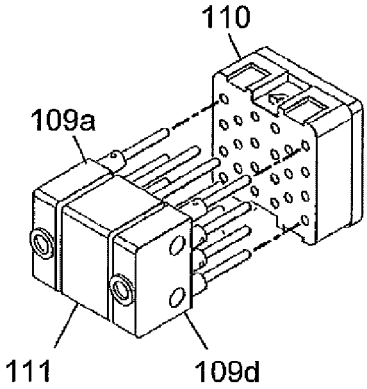
FIGS. 1D and 1E are perspective views illustrating incorporation of an electronic latching and/or blinking module into the pushbutton illuminated switch of FIGS. 1A-1C.
Figure 1E:
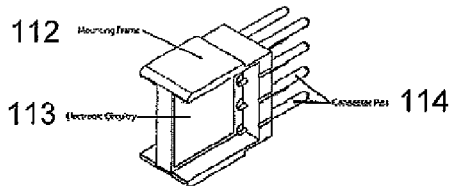
Figure 2:
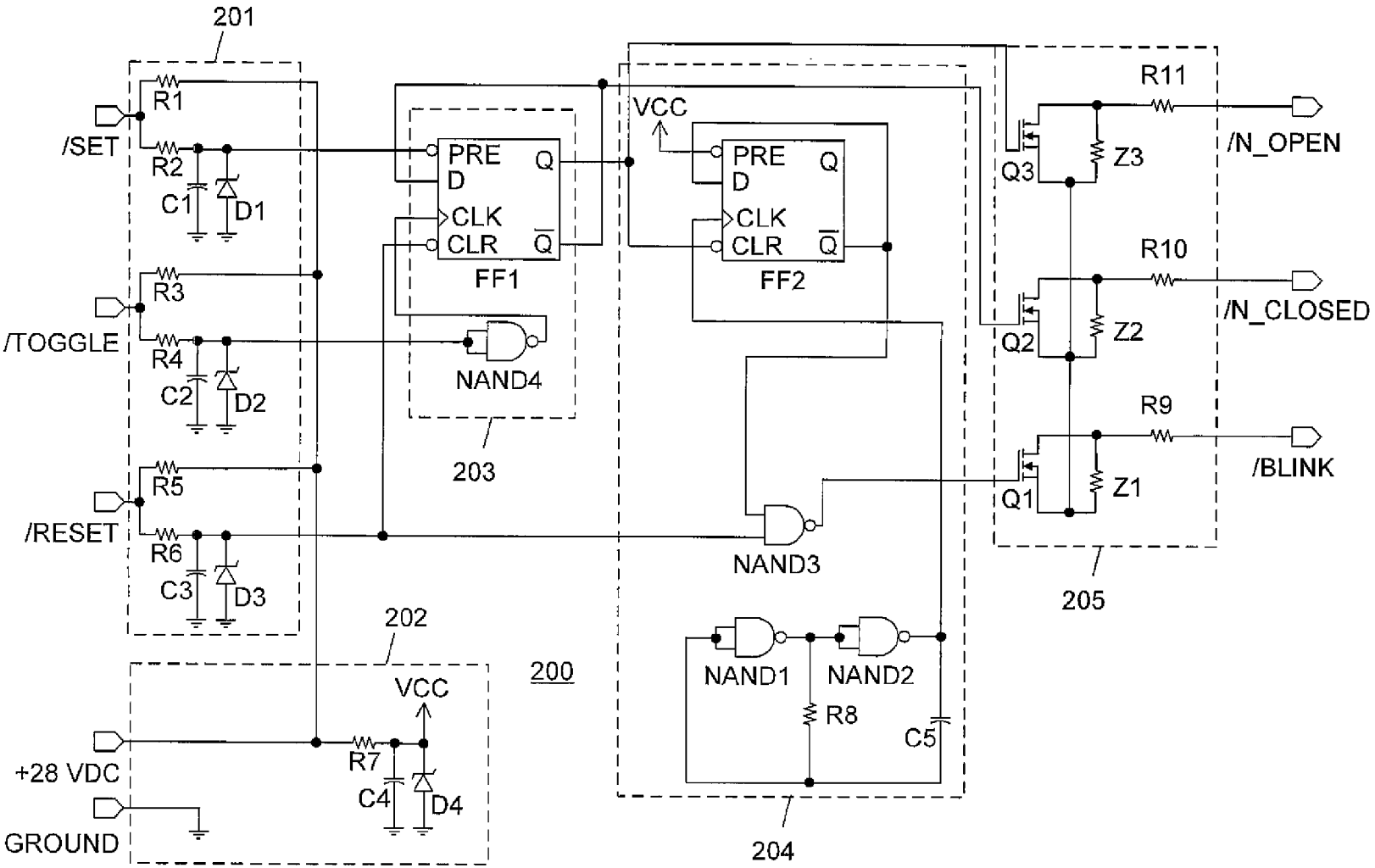
FIG. 2 is a circuit diagram for an electronic latching and/or blinking module according to one embodiment of the present disclosure.

FIGS. 1A through 2, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system.

FIGS. 1A, 1B and 1C are exploded perspective views of a pushbutton illuminated switch (or components thereof) with electronic latching and/or blinking according to one embodiment of the present disclosure. The pushbutton switch 100 includes a switch cap 101 and a switch body 102. The switch cap 101 is located at the front of the switch 100 and is received by the switch body 102. The switch cap 101 includes a switch cap housing 103 receiving an array 104 of surface mount diode (SMD) light emitting diodes (LEDs). The 2×4 LED array 104 in the exemplary embodiment has two rows of four LEDs arranged to illuminate four quadrants of a face plate (not shown) on the front of switch cap body 103, with two LEDs (a 1×2 subarray) per quadrant. The LEDs are mounted over a switch cap back plate 105 and are connected to an electrical driving circuit (not visible in FIG. 1B) mounted on the switch cap back plate 105. A member 106 for mechanical latching and release of the pushbutton switch when the switch cap 101 is depressed within the switch body 102 protrudes from the rear of switch cap back plate 105. Electrical connections (not shown) to the driving circuit are also exposed on the rear surface of switch cap back plate 105.

Switch body 102 includes a housing 107 receiving a mechanical and electrical subsystem 108 for mechanical latching and release of the pushbutton switch 100, for transmitting electrical signals to the driving circuit, and for transmitting mechanical forces to actuate four-pin snap-action switching devices 109*a* through 109*d*. Pins for the switching devices 109*a* through 109*d* are received by mounting block 110 and provide electrical switching by connections of the pins to external signal sources and/or through the subsystem 108 to the driving circuit. The pins of devices 109*a* through 109*d* extend through the mounting block 110 and may be connected at the rear of pushbutton switch 100 to external signals, to each other, and/or through subsystem 108 to the driving circuit.

Those skilled in the art will recognize that the complete structure and operation of a pushbutton switch of the type normally used in avionics is not depicted or described herein. Instead, for simplicity and clarity, only so much of the structure and operation of a pushbutton switch as is necessary for an understanding of the present disclosure is depicted and described. For example, filters between the LEDs and the switch cap face plate allow legends on the switch cap face plate to be illuminated in different colors as disclosed in U.S. Pat. No. 6,653,798, which is incorporated herein by reference. Numerous other features are also not depicted or described herein are or may be included within pushbutton switch 100.

FIGS. 1D and 1E are perspective views illustrating incorporation of an electronic latching and/or blinking module into the pushbutton illuminated switch of FIGS. 1A-1C. As shown in FIG. 1D, an electronic latching and/or blinking module 111 is inserted in place of switching devices 109*b* and 109*c*, with pins received by mounting block 110. FIG. 1E depicts a mounting frame 112 on which integrated electronic circuitry may be mounted, within one of the recesses 113. The electronic module 111 is coupled to a plurality of interface pins 114 (eight in the exemplary embodiment) each extending from the electronic circuitry through a portion of the mounting frame 112 to an endpoint and configured to pass through additional frames or housings (not shown) and engage additional electronic circuitry (not shown), in the same manner as pins for switching devices 109*b* and 109*c*. This approach provides the added functionality of the electronic module 111 with no increase in length, weight or mounting depth while retaining two uncommitted snap-action switching devices 109*a* and 109*d* that can be used to interact with the electronic module 111 or control other system functions.

FIG. 2 is a circuit diagram for an electronic latching and/or blinking circuit according to one embodiment of the present disclosure. Electronic latching and/or blinking circuit 200 is contained within the electronic module 111 within switch 100. TABLE I below contains the input and output signal descriptions for circuit 200, while TABLE II describes the logic input and output functions:

TABLE I

| SIGNAL NAME | FUNCTION | ACTIVE STATE | DESCRIPTION |
|---|---|---|---|
| /RESET | Input | Low | Forces /N_OPEN to OFF (open).<br>Forces /N_CLOSED to ON (ground).<br>Forces /BLINK to Steady ON (ground).<br>See Note 1 below. |
| /TOGGLE | Input | ↓ | Toggles /N_OPEN and /N_CLOSED outputs.<br>Toggles blink mode. See Note 2 below. |
| /SET | Input | Low | Forces /N_OPEN to ON (ground).<br>Forces /N_CLOSED to OFF (open).<br>Initiates 1 Hz blink mode to /BLINK output. |
| +28 VDC | Power | — | Power (+10 VDC to +30 VDC) |
| Ground | Common | — | Common for power and signals. |
| /N_OPEN | Output | Low | Open drain output.<br>Forced OFF (open) by /RESET input.<br>Forced ON (ground) by /SET input.<br>Toggled by falling edge of /TOGGLE input. |
| /N_CLOSED | Output | Low | Open drain output.<br>Forced ON (ground) by /RESET input.<br>Forced OFF (open) by /SET input.<br>Toggled by falling edge of /TOGGLE input. |
| /BLINK | Output | Low | Open drain output.<br>Forced ON (ground) while /RESET is held low.<br>See TABLE II below. |

TABLE II

| Inputs | | | Outputs | | |
|---|---|---|---|---|---|
| /SET | /RESET | /TOGGLE | /N_OPEN | /N_CLOSED | /BLINK |
| L | H | X | L (ground) | H (open) | 1 Hz blink mode. |
| H | L | X | H (open) | L (ground) | |
| L | L | X | See Note 3. | See Note 3. | Steady ON. See Note 1. |
| H | H | ↓ | Toggle state. | Toggle state. | Toggle. See Note 1. |

Note 1:

/BLINK output is held steady ON (ground) while /RESET is held low. /BLINK output goes OFF (open) when /RESET returns to the inactive high level. This feature provides essentially three states to the /BLINK output: OFF, ON and BLINK.

Note 2:

/TOGGLE input causes /BLINK output to alternate between 1 Hertz (Hz) blink state and OFF (open).

Note 3:

This is an illegal state that will have unpredictable effect upon the outputs when the inputs are returned to their normal inactive high state.

The logic input circuitry 201 for has a total of eight (8) interface pads each connected to an external pin of electronic module 111. Three interface pads are inputs: /SET, /RESET and /TOGGLE. Three interface pads are outputs: /N_OPEN (normally open), /N_CLOSED (normally closed) and /BLINK. Two additional interface pads are devoted to power: +28 VDC (volts, direct current) and Ground.

Each input pad is connected by two parallel resistors: resistors R1 and R2 for input /SET; resistors R3 and R4 for input /TOGGLE; and resistors R5 and R6 for input /RESET. One resistor of each parallel pair (R1, R3 and R5) is connected at the other terminal to the +28 VDC input power. The other resistor of each pair (R2, R4 and R6) is connected to one terminal of a capacitor (C1, C2 and C3, respectively) and to the cathode of a zener diode (D1, D2 and D3, respectively). The other capacitor terminals and the anodes of the zener diodes are connected to ground. Resistors R1, R2, R3, R4, R5 and R6 each have a resistance of 33 kilo-Ohms (KΩ). Capacitor C1 has a capacitance of 0.1 micro-Farads (μF) and each of capacitors C2 and C3 has a capacitance of 1.0 μF in the example depicted.

Each input to circuit 200 includes input filter circuitry designed to protect the integrated circuits from EMC, voltage transients, electromechanical contact bounce and shift the 28 VDC logic level to a 5 VDC logic level.

Resistors R2, R4 and R6 and zener diodes D1, D2 and D3 provide electromagnetic charge (EMC) protection and voltage transient protection to circuit 200, and shift the 28 VDC logic level to a 5 VDC logic level. Furthermore, complementary metal-oxide-semiconductor (CMOS) latch-up on extreme transients such as lightning or a conducted electromagnetic pulse (EMP) is prevented by clamping the inputs 0.5 VDC below the logic power supply voltage. Capacitors C1, C2 and C3 suppress electromechanical contact bounce. Resistors R5 and R6 and capacitor C3 on the /RESET input guarantee a default power-up state for circuit 200 since the power-up time constant of those components is substantially longer than that of both the logic power supply VCC (which has a lower resistance) and the /SET input (which has a much smaller capacitance). Pull-up resistors R1, R3 and R5 establish a default static logic level for the inputs, preventing floating logic states on unconnected inputs.

The logic power supply functional unit 202 generating the logic power supply voltage VCC for circuit 200 includes resistor R7 (which has a resistor of 15 KΩ), zener diode D4 and capacitor C4 (which has a capacitance of 1.0 μF) from the +28 VDC power input. Due to the low operating current of the CMOS logic circuitry within circuit 200, the value of resistor R7 is selected to limit the current of any EMC or voltage transient on the +28 VDC power pad. Transient suppression and voltage regulation on the +5.6 VDC logic power supply is provided by D4 while C4 provides filtering of input and logic transients. Because the logic power supply is a simple shunt voltage regulator, circuit 200 can operate over a wide input voltage range from below +10 VDC to in excess of +30 VDC.

Circuit 200 includes two high speed CMOS integrated circuits: a dual D-Type latch (FF1 and FF2) and a quad NAND gate (NAND1, NAND2, NAND3 and NAND3) implementing the latch logic 203 and the blink circuitry 204. The inverted preset input PRE of latch FF1 is connected by resistor R1 to the /SET input, while the input D of latch FF1 is connected to the inverting output of latch FF1. The clock input CLK of latch FF1 is coupled by NAND gate NAND4, configured as an inverter with the inputs tied together, by resistor R4 to the /TOGGLE input. The inverted clear input CLR of latch FF1 is connected by resistor R6 to the /RESET input.

Latch FF1 is the primary latching circuit that responds to the inputs /SET, /RESET and /TOGGLE as described in TABLE II above. NAND gate NAND4 is connected between the /TOGGLE input and the clock input of latch FF1 for the purpose of inverting the positive (leading) edge trigger of latch FF1 to a negative (trailing) edge trigger. The inverting output of latch FF1 is connected to the D input so that successive /TOGGLE inputs to latch FF1 result in a toggling action of latch FF1 non-inverting and inverting outputs Q and /Q. The non-inverting output Q from latch FF1 drives the normally open output /N_OPEN via n-channel enhancement mode metal-oxide-semiconductor field effect transistor (MOSFET) Q3, and the inverting output /Q from latch FF1 drives the normally closed output /N_CLOSED via MOSFET Q2. The non-inverting output Q of latch FF1 also holds latch FF2 in the reset state any time latch FF1 is in the reset state.

Blink circuitry 204 includes series connected NAND gates NAND1 and NAND2 configured as inverters with the respective inputs tied together and are interconnected as a dual inverting buffer that, together with resistor R8 (having a resistance of 220 KΩ) connecting a feedback loop from the output of NAND gate NAND2 to the input of NAND gate NAND1 with the input to NAND gate NAND2 and capacitor C5 (having a capacitance of 1.9 μF) connected in the feedback loop, form a free running square wave oscillator with a fundamental frequency $F=1/(2.2\times R8\times C5)$ of approximately 2 Hertz (Hz). The output of that oscillator feeds the clock input CLK of latch FF2, where the inverting output /Q of latch FF2 is connected to the D input so that latch FF2 functions as f/2 frequency divider. The inverted preset input PRE of latch FF2 is tied to the logic supply voltage VCC. Because the inverted clear input CLR of latch FF2 is connected to the non-inverting output Q of latch FF1, the f/2 divider circuit is effectively disabled any time latch FF1 is in the reset state. The f/2 divided frequency output of latch FF2 creates the 1 Hz blink mode oscillator, enabled only when latch FF2 is in the set state.

The enabled 1 Hertz blink signal from the inverting output /Q of latch FF2 is connected, along with the filtered /RESET input, each to one input of NAND gate NAND3. NAND gate NAND3 thus serves as blink logic, forcing the /BLINK output to be held in a steady ON state any time the /RESET input signal is held low. The output of NAND gate NAND3 is connected to MOSFET Q1 to provide the /BLINK output of circuit 200.

Each output from the circuit 200 includes a power MOSFET Q1, Q2 or Q3 each rated at 2.5 ampere (A) at 45 VDC (both parameters chosen to be substantially greater than operational requirements) and an output filter designed to protect each output device from transients and overload conditions. Transient protection for the MOSFETs Q1, Q2 and Q3 is provided by impedances Z1, Z2 and Z3, each having a breakdown voltage of 39 VDC. Overload protection is provided by resettable Positive Temperature Coefficient (PTC) resistors R9, R10 and R11 with a holding current of 0.5 A at elevated temperatures. These devices perform the function of a fuse, limiting current in the event of a short or overload, but automatically return to their normal state when the short or overload is removed. In order to provide the highest possible reliability, each output /N_OPEN, /N_CLOSED and /BLINK is derated to a maximum operating current of 0.5 A.

The features of activating switch functions from a remote location, energizing or blinking a local or remote display, resetting the switch state automatically upon remote acknowledgement, changing the state of a switch or display at one location based on another, remote switch controlling the same function being depressed, and automatic reset to a default state after loss of power are implemented in the present disclosure by replacing the traditional electromagnetic holding coil within the illuminated pushbutton switch housing with a subminiature electronic logic module. The logic module provides many additional features beyond the simple latching or on/off toggling functionality that is typical of an electromagnetic holding coil, including lower size and weight, longer switch life, no electrical spikes, remote set and reset capability, display blinking, and high reliability electronic driver circuits that can drive modest electrical loads.

Although the above description is made in connection with specific exemplary embodiments, various changes and modifications will be apparent to and/or suggested by the present disclosure to those skilled in the art. It is intended that the present disclosure encompass all such changes and modifications as fall within the scope of the appended claims.

What is claimed is:

1. A circuit for latching an illuminating pushbutton switch comprising:

inputs receiving set, reset and toggle control signals;

outputs delivering open, closed and blink control signals;

latch logic controlled by the set and reset control signals, a first output of the latch logic delivering a first signal selected to maintain the illuminated pushbutton switch in an open state to the open control signal output and a second output of the latch logic delivering a second signal selected to maintain the illuminated pushbutton switch in a closed state to the closed control signal output; and a frequency divider and oscillator coupled together to deliver, based upon the set and reset control signals, a signal to the blink control signal output that alternates at a selected frequency between a signal selected to maintain the illuminated pushbutton switch in the open state and the signal selected to maintain the illuminated pushbutton switch in the closed state, wherein the circuit fits within a housing for the illuminated pushbutton switch within a space sized to hold two snap action switching devices, and the inputs and outputs are coupled to external pins from the illuminated pushbutton switch.

2. The circuit of claim 1, wherein the latch logic further comprises:

a first latch set by the set control signal and cleared by the reset control signal, the first signal from the latch logic based upon a non-inverting output of the first latch and the second signal from the latch logic based upon an inverting output of the first latch.

3. The circuit of claim 2, wherein the frequency divider further comprises:

a second latch having an input connected to an inverting output of the second latch, the frequency divider disabled based on the outputs of the first latch.

4. The circuit of claim 1, wherein delivery of the signal from the frequency divider to the blink control signal output is gated based on the reset control signal.

5. The circuit of claim 1, further comprising:

an inverter coupling the toggle control signal to a clock input of the first latch, wherein a trailing edge of a pulse in the toggle control signal changes the outputs of the first latch between set and reset states.

6. The circuit of claim 1, further comprising:

filters coupled to each of the inputs to filter transient signals;

voltage level shift devices coupled to each of the inputs to shift a power supply voltage to a logic level voltage.

7. The circuit of claim 1, further comprising:

protection devices coupled to each of the outputs to protect the circuit from transient signals and overload conditions.

8. A method of latching an illuminating pushbutton switch using a circuit having inputs receiving set, reset and toggle control signals at input and outputs delivering open, closed and blink control signals, the method comprising:

controlling latch logic with the set and reset control signals, a first output of the latch logic delivering a first signal selected to maintain the illuminated pushbutton switch in an open state to the open control signal output and a second output of the latch logic delivering a second signal selected to maintain the illuminated pushbutton switch in a closed state to the closed control signal output; and based upon the set and reset control signals, controlling a frequency divider and oscillator coupled together to deliver a signal to the blink control signal output that alternates at a selected frequency between a signal selected to maintain the illuminated pushbutton switch in the open state and the signal selected to maintain the illuminated pushbutton switch in the closed state, wherein the circuit fits within a housing for the illuminated pushbutton switch within a space sized to hold two snap action switching devices, and the inputs and outputs are coupled to external pins from the illuminated pushbutton switch.

9. The method of claim 8, further comprising:

setting a first latch within the latch logic by the set control signal and clearing the latch by the reset control signal, the first signal from the latch logic based upon a non-inverting output of the first latch and the second signal from the latch logic based upon an inverting output of the first latch.

10. The method of claim 9, wherein the frequency divider includes a second latch having an input connected to an inverting output of the second latch, the method further comprising:

disabling the frequency divider based on the outputs of the first latch.

11. The method of claim 8, further comprising:

gating delivery of the signal from the frequency divider to the blink control signal output based on the reset control signal.

12. The method of claim 8, further comprising:

coupling the toggle control signal to a clock input of the first latch, wherein an edge of a pulse in the toggle control signal changes the outputs of the first latch between set and reset states.

13. The method of claim 8, further comprising:

filtering transient signals at each of the inputs;

shifting a power supply voltage to a logic level at each of the inputs.

14. The method of claim 8, further comprising:

protecting the circuit from transient signals and overload conditions at each of the outputs.

* * * * *